United States Patent [19]

Cybriwsky et al.

[11] 3,990,865

[45] Nov. 9, 1976

[54] PROCESS FOR COAL GASIFICATION UTILIZING A ROTARY KILN

[75] Inventors: Alexander Cybriwsky, Greenfield; Gerald T. Petersen, Elm Grove, both of Wis.

[73] Assignee: Allis-Chalmers Corporation, Milwaukee, Wis.

[22] Filed: Oct. 21, 1974

[21] Appl. No.: 516,807

[52] U.S. Cl. ..... 48/197 R; 48/202; 48/206; 202/216

[51] Int. Cl.[2] ..... C10J 3/00; C10J 3/16

[58] Field of Search ..... 48/210, 202, 206, 197 R, 48/99, 73, 63, 122; 201/9

[56] References Cited

UNITED STATES PATENTS

| | | | |
|---|---|---|---|
| 1,916,900 | 7/1933 | Vandegrift et al. | 201/9 |
| 2,582,712 | 1/1952 | Howard | 201/28 X |
| 3,736,233 | 5/1973 | Sass et al. | 48/210 X |
| 3,884,649 | 5/1975 | Matthews | 48/202 |

*Primary Examiner*—Norman Yudkoff
*Assistant Examiner*—Barry I. Hollander
*Attorney, Agent, or Firm*—John P. Hines

[57] ABSTRACT

A rotary kiln coal gasification process capable of processing caking coals wherein controlled agglomeration of the coal is permitted without adverse process effects. Caking coals have an agglomerating temperature range and while in this range the coal is in a semi-plastic state which causes individual particles to stick together on contact and form agglomerates. After passing through this agglomerating temperature range, during which most volatiles and tars are removed, a temperature is reached where the coal particles become less sticky and, with sufficient agitation and maintenance of bed temperature, the agglomerates will break up. In this process the temperature of the coal is increased at an accelerated rate to cause it to quickly pass through the agglomerating temperature range before excessive agglomeration occurs and adversely affects desired material flow through the kiln.

7 Claims, 4 Drawing Figures

PROCESS FOR COAL GASIFICATION UTILIZING A ROTARY KILN

This invention pertains in general to a rotary kiln gasification process for solid carbonaceous material such as coal and more particularly to such a process capable of utilizing coals having a caking tendency ranging from mild to strong and wherein controlled agglomeration of the coal is permitted without adverse consequences to process performance.

BACKGROUND OF THE INVENTION

Gasification of coal in a rotary kiln is quite an old process as witnessed by U.S. Pat. No. 247,322, issued Sept. 30, 1881. The following is a list of patents which indicate generally the development of coal gasification in rotary kilns. It should be understood that this list of patents is not intended to be exhaustive but is merely a list of representative patents pertaining to coal gasification utilizing a rotary kiln: U.S. Pat. No. 596,428; French Pat. No. 149,049; U.S. Pat. No. 715,144; British 7,592; U.S. Pat. No. 868,026; U.S. Pat No. 1,159,675; U.S. Pat. No. 1,267,410; U.S. Pat. No. 1,270,949; U.S. Pat. No. 1,413,779; U.S. Pat. No. 1,423,134; U.S. Pat. No. 1,441,542; U.S. Pat. No. 1,480,148; U.S. Pat. No. 1,480,152; U.S. Pat. No. 2,659,668 and U.S. Pat. No. 3,692,505.

The recent realization of the growing "energy crisis" has pointed out the need for the United States to strive toward the goal of energy self-sufficiency by finding environmentally acceptable ways in which to utilize our greatest domestic energy resource - coal. It is quite universally accepted that coal gasification, followed subsequently by appropriate gas cleanup and sulfur removal, will play a major role in the successful utilization of the coal deposits in the United States.

One use of gasified coal is the production of electricity. In such a process, a low BTU gas produced from coal is used as a utility steam boiler or combined cycle fuel. In order for such process to be viable and economically attractive for utility application, two inherent prerequisites must be fulfilled: (1) tremendously large amounts of coal must be gasified, and (2) the coal most readily available to the utility site should be utilizable. It is interesting to note that most of the electrical demand and hence the most electrical utility generating sites within the U.S. are located east of the Mississippi. Unfortunately, most of the known coal reserves in the same geographic region are typically of a moderate to strongly caking variety which historically have been difficult to process.

In summary, this creates a demand for a gasification process capable of processing quantities of coal on an unprecendented scale (100's of tons per hour) with coals exhibiting a wide range of caking properties not readily processed by currently available commercial process technology. One of the more efficient ways of gasifying large amounts of caking coal is in a continuous gasifying process utilizing a rotary kiln.

Coal is a complex substance and therefore does present quite a few problems which must be solved before successful economical gasification can be realized. Not the least of these problems is the caking characteristics which many of these coals exhibit. In order to gasify the coal, the temperature of the coal has to be increased to high temperatures. In order to achieve practical rates of gasification, this temperature typically ranges between 1600° – 2600° F. As the coal temperature is increased, the coal passes through a semi-plastic state in which it becomes sticky due to the evolution of volatile and tar products and other factors related to continuous changes in the coal structure. While in this state, (which can be referred to as the agglomerating temperature range) pieces of coal stick together and form agglomerates which, in certain instances, can adversely affect the proper operation of the coal gasifier. In some instances, the agglomerates may reach sufficient size and number so as to upset normal continuous material flow through the process. In other instances, agglomerates may actually clog the kiln discharge opening or other process equipment downstream from the kiln.

In the past, efforts were made to entirely avoid caking coal from forming agglomerates. Examples of such efforts can be found in the following patents: U.S. Pat. No. 1,159,675, issued to J. W. Hornsey; U.S. Pat. No. 1,916,900, issued to J. N. Vandegrift et al; U.S. Pat. No. 2,659,668, issued to B. J. Mayland, Nov. 17, 1953; U.S. Pat. No. 3,692,505, issued to E. H. Reichl, Sept. 19, 1972 and British Pat. No. 278,378. The Hornsey patent attempts to prohibit agglomeration by using coal in powder form and providing buckets, cradles and rings in the kiln which sufficiently agitate the coal so that agglomerates do not form. Both the Vandegrift and Mayland patents attempt to prohibit agglomeration by treating coal with gas or air to provide a nonsticky layer about the coal so that as it passes through the semi-plastic state, the surface is not sticky and therefore does not adhere to adjacent coal particles. The Reichl patent attempts to prohibit agglomeration by introducing noncaking pellets into the kiln in sufficient proportions to ensure that the resultant mixed bed will not cake. The British patent indicates that the caking coal must be mixed with other substances, such as water, to reduce the caking tendency.

SUMMARY OF THE INVENTION

Applicants have determined that the undesirable caking characteristic of coal can best be handled, not by attempting to avoid agglomeration of the coal, but by controlling the agglomeration. It is quite well known that caking coals do enter the semi-plastic or sticky stage as they approach the devolatilization temperature range. While in this devolatilization temperature range, normally for most caking coals between the temperatures of 700° and 1200° F if they are not pretreated, agglomeration will occur. However, applicants have determined that:

1. by limiting or regulating the exposure time of the coal in the agglomeration temperature range,
2. by increasing the temperature beyond the agglomerating temperature range, and
3. by providing sufficient bed tumbling action at a temperature above the agglomeration temperature range the agglomerates that are formed can be limited in size and number and those that do form can be broken down so that the desired material flow characteristics of the process are not adversely affected (i.e., gasification can be efficiently performed).

The temperature at which different coals lose their tendency to agglomerate varies from greater than 1200° F to less than 1600° F, depending on the type of coal utilized; however, it has been found from experimentation that 1600° F is a temperature at which most coals have passed through the agglomeration temperature range and will eventually break up provided sufficient exposure time and tumbling action is experienced at or above this higher temperature.

It is, therefore, the intention and general object of this invention to provide a rotary kiln coal gasification process which utilizes caking coal wherein the amount of agglomeration of the coal is controlled.

An additional object of the subject invention is to provide a rotary kiln coal gasification process of the hereinbefore described type wherein the time in which the coal remains in the agglomerating temperature range is regulated so as not to permit excessive agglomeration buildup and thereby adversely affect the gasification process.

A more specific object of the subject invention is to provide a rotary kiln coal gasification process of the hereinbefore described type wherein a regulated amount of hot gas or combustion air is admitted directly to the bed of coal in a selected region of the kiln where the devolatilization and agglomeration of the coal occurs.

BRIEF DESCRIPTION OF THE DRAWINGS

The above and other objects of the subject invention will become more fully apparent as the following specification is read in light of the attached drawings in which.

DESCRIPTION

Figure 1:
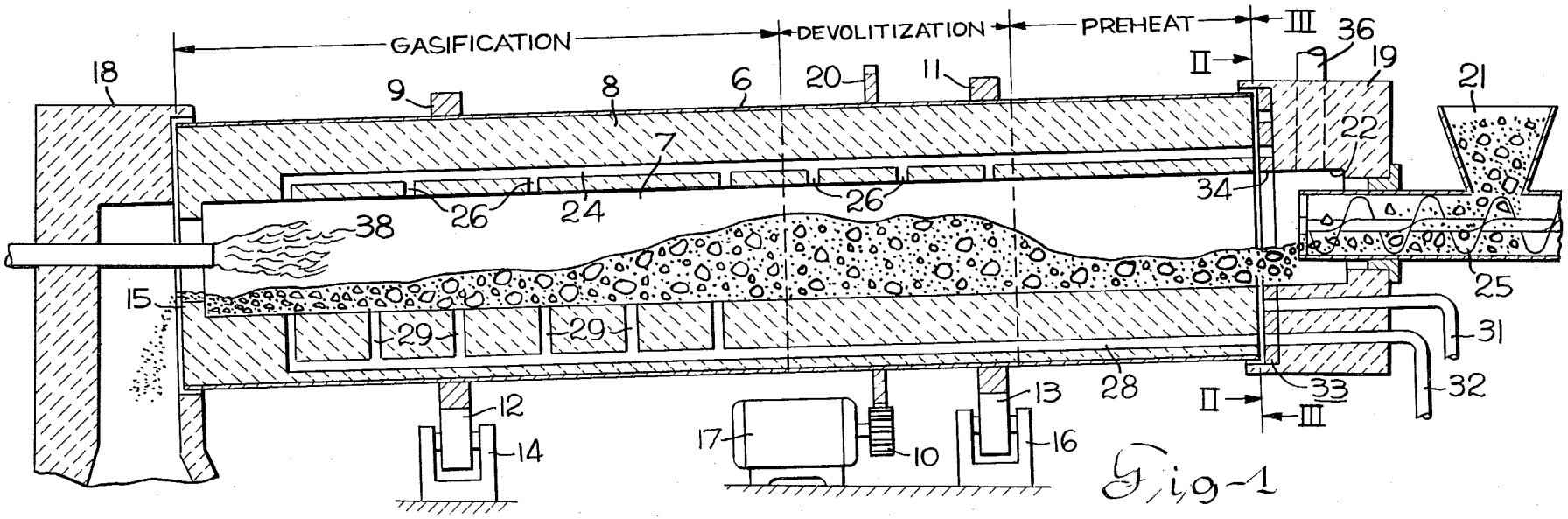
FIG. 1 is a side elevation partly in section of a rotary kiln coal gasifier in which the subject process can be practiced.

Referring to the attached drawings, the kiln shown herein for purposes of illustration is provided with an elongated cylindrical body portion 6 which defines a cylindrical chamber 7. The wall 8 of the kiln may be constructed of any suitable refractory material such as firebrick. Any means may be provided for supporting kiln and, as shown herein for purposes of illustration, a pair of axially spaced annular girth rings 9 and 11 are provided about the outer peripheral surface of the kiln body. These annular rings may be supported on wheels 12 and 13 rotatably contained in conventional journal bearings 14 and 16, respectively. Rotation of the kiln may be provided by any conventional means and is herein shown as including a motor generally designated 17 which is provided with a driving gear 10 meshed with a girth gear 20 connected to the kiln body.

A stationary end piece 18 is provided at the discharge end of the kiln and a stationary end piece 19 is also provided at the intake end of the kiln. The discharge end piece 18 has an opening therein which aligns with the cylindrical chamber 7 in the kiln so that the unreacted portion of the coal usually in the form of coal ash can pass from the kiln. The discharge end piece 18 is provided with an annular flange 15 which provides a dam to enable the desired bed depths to be achieved.

An opening 22 in the intake end piece 19 is in alignment with the cylindrical chamber 7. A feed hopper 21 may extend into the opening 22 providing a means of supplying the continuous charge of coal to the cylindrical chamber within the kiln. As herein shown for purposes of illustration, the feed hopper is provided with a screw 25 for conveying the coal to the kiln. Both end pieces 18 and 19 are stationary and the kiln rotates relative to these end pieces. The end pieces may be flanged as shown to provide a close running fit with the kiln body, and necessary seals of any conventional type (not shown) may be included to seal the chamber 7 from the atmosphere. For ease of description, the kiln can be considered as being divided into three zones identified as the preheat zone, the devolatilzation zone and the gasification zone. It should be understood that while the different steps of the process of this invention do generally take place in the zones of the kiln as indicated, each step does not terminate precisely at the boundary between adjacent zones.

A series of circumferentially spaced longitudinally extending passageways 24 may be provided in the side wall of the kiln. A series of longitudinally spaced radially directed ports 26 connect the longitudinal passageways with the cylindrical chamber 7 in both the devolatilization and gasification zones. An additional series of circumferentially spaced longitudinally extending passageways 28 are also provided in the side wall of the kiln. Passageways 28 are spaced radially outwardly from the passageways 24 and also communicate with the chamber 7 through another series of radially directed ports 29 but only into the gasification zone.

It should be understood that although the invention has been shown with the passageways 24 and 28 extending within the kiln shell or side wall, it would be possible to provide pipes about the outer periphery of the kiln body without departing from the spirit of the invention. In this instance, valving could be provided as is shown in U.S. Pat. No. 3,794,483 to permit selective admission of the gases to particular locations in the kiln such as beneath the bed only.

Two pipes 31 and 32 are provided at the end piece 19 and extend therethrough and terminate adjacent to the end of the passageways 24 and 28, respectively. The pipe 31 is connected with a source of oxidizing gas such as air and the pipe 32 is connected with a source of steam (not shown). Naturally, passageways 24 and 28 may be used for the admission of other gases such as nitrogen or a combination of gases such as air and steam.

A manifold generally designated 33 is positioned between the end surface of the kiln body and the end piece 19. This manifold 33 may be constructed of a diameter equal to the diameter of the kiln body and is provided with an opening 34 therethrough which aligns with the opening at the end piece 19 and the cylindrical chamber 7 to permit the passage of the coal charge therethrough. A first circular slot 35 is provided through the manifold 33 to align the longitudinally extending passageways 28 with the pipe 32 for admission of steam. An additional circular slot 37 through the manifold aligns with the longitudinally extending passageways 24 and the pipe 31 for the admission of air.

In operation the kiln is rotated by the motor 17 and at the same time preheated to the desired temperature by the burner flame 38. When the kiln has reached the desired temperature, the charge of coal is fed into the kiln through the opening 34. As the kiln is rotated, the coal moves to the left due to the rotary action and the declining orientation of the kiln. Air and steam are preferably admitted through the ports 26 and 29 when the coal covers the ported zones of the kiln. As the coal is gasified, the off-gas or product gas flows to the right and out the product gas discharge 36. After the kiln has been loaded and the gasification temperature of the coal bed has been reached, the flame 38 can be extinguished as the process temperature is substantially self-sustaining. The hot product gases flowing over the devolatilization and preheat zones transfer heat to the coal bed and cause the coal temperature to increase.

Figure 4:
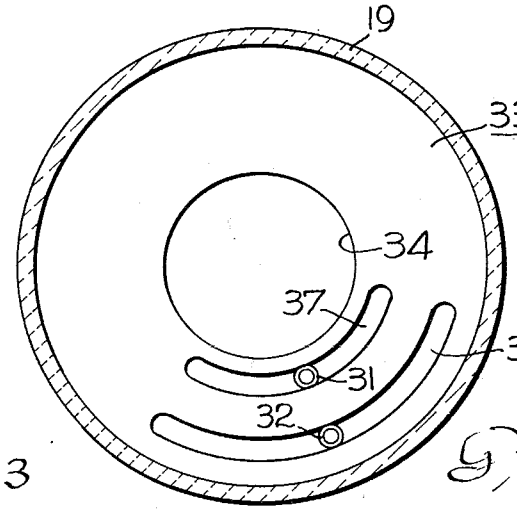
FIG. 4 is a modified form of manifold.
Figure 3:
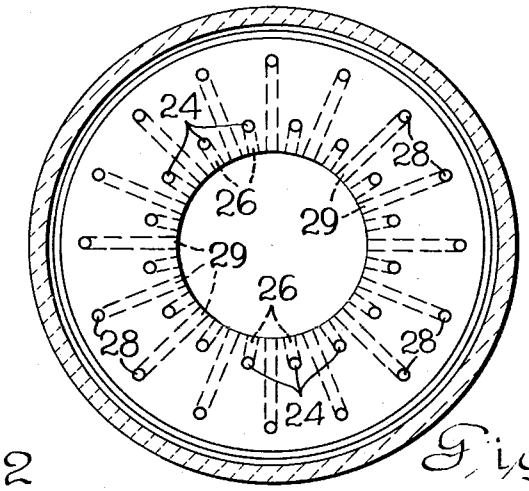
FIG. 3 is a cross section taken along the line III—III (view to left) of FIG. 1.
Figure 2:
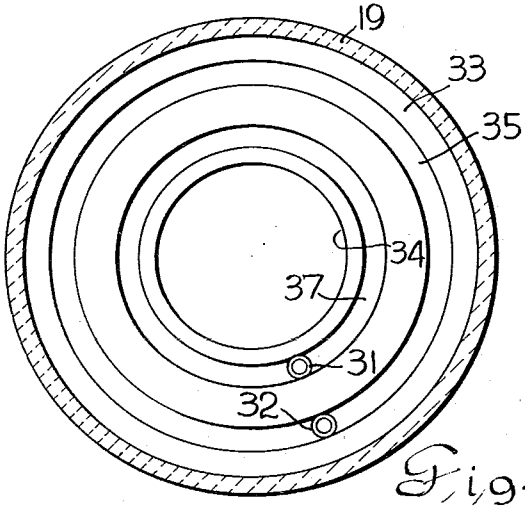
FIG. 2 is a cross section taken along the line II—II (view to right) of FIG. 1 showing the gas manifold.

In certain applications, it may be desirable to admit the air and steam only under the bed of coal. Any form of valving arrangement may be employed to accomplish this such as the structure disclosed in U.S. Pat. No. 3,794,483. FIG. 4 shows a modified form of manifold 33 which will also accomplish this. The slots 35 and 37 conform to the cross sectional shape of the bed. Therefore, air and steam can pass through the manifold only when the passageways 24 and 28 are beneath the bed.

In the preheat zone the temperature of the coal is increased by the off-gas passing above the coal bed to a temperature of about 600° F, depending on the type of coal utilized. The purpose of the preheat zone is to provide a transition temperature range in which any moisture remaining in the coal is driven off. The coal is caused to move through the preheat zone at a rate so that it reaches the vicinity of the devolatilizing zone before it has reached the agglomerating temperature for the particular coal being processed. Since the amount of agglomeration is dependent on the time the coal remains in the agglomerating temperature range, it is desired to cause the coal to agglomerate in that zone of the kiln where the temperature of the coal can be controlled. Since the devolatilizing zone is provided with ports 26, the residence time of the coal in the agglomerating temperature range can be quite precisely controlled in this zone of the kiln. Therefore, if the coal is caused to attain both the agglomerating and nonagglomerating temperatures substantially within the devolatilizing zone, the number and size of the agglomerates can be effectively controlled.

The devolatilization onset temperature varies depending on the type of coal involved but is in the neighborhood of 600° to 800° F for most coals. Once the coal reaches this temperature, it becomes semi-plastic and if of a caking variety begins to agglomerate. Sufficient hot gas or combustion air is admitted through the ports 26 while they are under the coal bed in the devolatilization zone to quickly raise the temperature of the coal to that temperature at which the particular coal being processed no longer exhibits a tendency to agglomerate. It has been determined that most agglomerated coal will begin to break up upon sufficient rotation in a rotary kiln if its temperature is raised to, and maintained at or above, a temperature of approximately 1600° F. Most coals will pass through the semiplastic state between the temperatures of 600° and 1600° F. which can be referred to as the agglomerating temperature range. The time of raising the temperature of the coal from the beginning of the semi-plastic state (the agglomerating temperature) to the temperature at which the agglomerates begin to break down (the nonagglomerating temperature) is controlled by the amount of air or oxygen admitted through the ports 26 in the devolatilization zone. The coal temperature must be increased to the nonagglomerating temperature of the particular coal being processed before the agglomerates grow to sufficient size and number to adversely affect proper material flow through the kiln.

The growth of agglomerates is dependent upon the agglomerating properties of coal commonly characterized by its free swelling index (FSI). Coals have been categorized according to their FSI and scale from 0–10. The higher the FSI, the higher the growth rate of agglomerates. As an example, applicants have determined that for a coal with an FSI of 7–8, the growth rate of the agglomerated balls while in the agglomerating temperature range is about 0.8 inches per minute in diameter while for a moderately agglomerating coal with an FSI of 3–5, the growth rate is about 0.4 inches per minute in diameter of the ball. If we assume a system utilizing the process of this invention which can operate satisfactorily with agglomerated ball sizes up to 12 inches, the exposure time of coal in the agglomerating temperature range is limited to about 15 minutes or less for high caking coals or 30 minutes or less for medium caking coals. The system operator will determine by test or will be informed by the process designer; the maximum allowable ball size which can be accommodated by the system without adversely affecting the process. He can regulate the heat in the devolatiliation zone to insure that the coal passes through the agglomerating temperature range before excessively large agglomerated balls have formed.

Once the coal has reached the nonagglomerating temperature, it is in the vicinity of the gasification zone. Additional air is admitted through the ports 26 and steam through the ports 29 to effect gasification. The controlled agglomerates are broken up due to the temperature and tumbling action of the bed. The coal is caused to remain in the gasification zone until the agglomerates have broken down and substantially complete gasification has occurred.

From the above description, it can be seen that applicants have developed a process for utilizing a caking coal which controls the amount of agglomeration of the coal. With this process, no special pretreatment of the coal is required nor is a special type or particle size of coal required. The process provides that the coal pass through the agglomerating temperature range sufficiently fast so that excessive agglomeration does not occur and adversely affect the gasification process.

The embodiments of the invention in which an exclusive property or privilege is claimed are defined as follows:

1. A process of continuously gasifying a solid carbonaceous material, which has a tendency to agglomerate at a predetermined rate depending on its free swelling index after it attains an agglomerating temperature and which loses its tendency to agglomerate at a higher nonagglomerating temperature, in an inclined rotating kiln having means for the selective admission of fluid into said kiln and at least two zones for devolatilizing and gasifying said material and wherein said process is capable of processing agglomerated carbonaceous material up to a predetermined agglomerate size without adversely affecting the movement of the carbonaceous material through said kiln, said process comprising the steps of:

a. feeding a continuous supply of said carbonaceous material to said kiln;
b. causing a tumbling bed of said material to form within said kiln;
c. causing said bed to move along said kiln into the vicinity of said devolatilizing zone;
d. admitting sufficient heat to said bed in said devolatilizing zone to raise the temperature of said material therein to said nonagglomerating temperature before the agglomerates have grown to a size greater than said predetermined agglomerate size;

e. admitting steam to said bed in said gasifying zone to cause gasification of said material; and f. continuing to rotate said kiln to provide sufficient tumbling action so that the agglomerated material in said devolatilizing zone which has attained said nonagglomerating temperature and the agglomerated material in said gasifying zone will break up before passing completely through said kiln.

2. The process set forth in claim 1 wherein the heat admitted in step (d) is obtained by admitting air directly to said bed to cause combustion of the material and thereby an increase in temperature of the material.

3. A process of continuously gasifying a solid carbonaceous material, which has a tendency to agglomerate at a predetermined rate depending on its free swelling index after it attains an agglomerating temperature and which loses this tendency at a higher nonagglomerating temperature, in an inclined rotating kiln which is divided into three operating zones for preheating, devolatilizing and gasifying said material, said kiln having an inlet and an outlet, means for selectively increasing the temperature of said kiln in said devolatilizing and gasifying zones and means for selectively admitting steam into said gasifying zone, and wherein said process is capable of processing agglomerating carbonaceous material up to a predetermined agglomerate size, said process comprising the steps of:

a. feeding a continuous supply of said carbonaceous material through said inlet to form a tumbling bed of material in said preheat zone;

b. increasing the temperature of said material in said preheat zone;

c. causing said material to move through said preheat zone at a rate such that the temperature of said material does not attain said agglomerating temperature until it is in the vicinity of said devolatilizing zone;

d. increasing the temperature of said material in said devolatilizing zone to said nonagglomerating temperature at a rate such that the agglomerates do not grow to a size greater than said predetermined size;

e. causing said material to move through said devolatilizing zone at a rate such that the temperature of said material has reached said nonagglomerating temperature when the material enters said gasifying zone;

f. admitting steam into said gasifying zone to cause gasification of said material;

g. continuing to rotate said kiln so that the agglomerated material which has attained and exceeded said nonagglomerating temperature will tumble and break down before passing completely through said gasifying zone; and h. discharging the unreacted material from said outlet of said kiln.

4. The process set forth in claim 3 wherein air is admitted directly beneath the bed of material in said devolatilizing zone to cause combustion of said material and thereby increase the temperature of said material.

5. The process set forth in claim 3 wherein the hot product gas is caused to circulate above and thereby increase the temperature of the material in the devolatilizing and preheat zones.

6. The process set forth in claim 3 wherein oxygen is admitted to said bed of material to increase the temperature in step (d).

7. A process of continuously gasifying a solid carbonaceous material which has a tendency to agglomerate at a temperature of about 600° F. and which loses this tendency at a nonagglomerating temperature of about 1600° F. in an inclined rotating kiln having means for the selective admission of fluid into said kiln and at least two zones for devolatilizing and gasifying said material, and wherein said process is capable of processing agglomerated carbonaceous material up to a predetermined agglomerate size without adversely affecting the movement of said carbonaceous material through said kiln, said process comprising the steps of:

a. feeding a continuous supply of said carbonaceous material to said kiln at a temperature below 600° F.;

b. causing a tumbling bed of said material to form within said kiln;

c. causing said bed to move along said kiln into the vicinity of said devolatilizing zone;

d. admitting sufficient heat into said bed in said devolatilizing zone to raise the temperature of said material therein to 1600° F. before the agglomerates have grown to said predetermined size;

e. admitting steam to said bed in said gasifying zone to cause gasification of said material; and f. continuing to rotate said kiln to provide sufficient tumbling action so that the agglomerated material in said devolatilizing zone which has attained said nonagglomerating temperature and the agglomerated material in said gasifying zone will break up before passing completely through said kiln.

* * * * *